United States Patent [19]

Schwarz

[11] Patent Number: 4,676,080

[45] Date of Patent: Jun. 30, 1987

[54] LOCKING ARTICLE FOR CYCLE ACCESSORIES

[76] Inventor: Edward Schwarz, 2825 Brookwood Terr., Minneapolis, Minn. 55410

[21] Appl. No.: 837,175

[22] Filed: Mar. 7, 1986

[51] Int. Cl.[4] ..... E04B 69/00

[52] U.S. Cl. ..... 70/59; 70/58; 70/49

[58] Field of Search ..... 70/59, 58, 18, 30, 49; 24/114.5, 265 M; 248/551-553; 211/4

[56] References Cited

U.S. PATENT DOCUMENTS

| | | | |
|---|---|---|---|
| 3,002,780 | 10/1961 | Cageman | 24/129 |
| 3,581,531 | 1/1971 | Hediger | 70/59 |
| 3,798,934 | 3/1974 | Wright | 70/59 |
| 4,003,228 | 1/1977 | Lievens | 70/58 |
| 4,212,175 | 7/1980 | Zakow | 70/58 |
| 4,418,550 | 12/1983 | Hamilton | 70/18 |
| 4,526,125 | 7/1985 | Bain | 70/18 |
| 4,546,627 | 10/1985 | Sharwder | 70/18 |

*Primary Examiner*—Henry E. Raduazo

*Attorney, Agent, or Firm*—Edward Schwarz

[57] ABSTRACT

An article which can be used cooperatively with a padlock for locking an accessory with a hole within its body such as the typical bicycle helmet, has a flexible cable loop with a stop permanently attached to it. The loop can be bent to allow it to enter the accessory hole and the stop is too large to pass through the hole without permanently distorting either the stop or the hole. The padlock is then used to attach the portion of loop passed through the hole to a convenient permanent fixture.

11 Claims, 3 Drawing Figures

LOCKING ARTICLE FOR CYCLE ACCESSORIES

BACKGROUND

It is imperative that bicyclists and motorcyclists wear their safety helmets whenever riding. However, particularly with bicyclists, a serious problem in achieving this ideal has been how to secure the helmet after reaching an away-from-home destination. Bicycle and motorcycle helmets are not heavy but are bulky and therefore inconvenient to carry when off the cycle. Heretofore there has been no convenient and secure means for locking a helmet to allow it to be left unattended. The approach frequently taken to lock motorcycle helmets is to pass a locking mechanism possibly integral with the motorcycle frame through the metal chin strap loop. However, these loops are relatively thin metal and can be easily cut by ordinary pliers or diagonal cutters. Since the chin straps themselves are mere fabric, albeit with great tensile strength, they can be easily cut with a common pocket knife, and then a new loop and portion of the strap sewn on by the thief to restore the helmet to useable condition.

Bicycle helmets are another problem in that bicycles do not have integral locking mechanisms and the typical U frame open-shackle bicycle padlocks (hereafter U locks) are of stock too large to pass through the chin strap loop. Frequently these helmets either have vent holes or may be drilled to provide a hole through which a U lock shackle may be passed to lock the helmet to the bicycle and the external fixture. But the bulkiness of these helmets and the smaller size of these U lock shackles may prevent locking the frame, both wheels, and the helmet to the larger permanent fixtures frequently available, such as parking meters, posts and small trees. Furthermore, locking the helmet directly with a U lock places the helmet in direct contact with the U lock, and near to the chain and the lower parts of the frame, all of which are frequently dirty and may soil the helmet. This will eventually lead to the rider and his or her clothes becoming soiled.

Thus, one can see that the conventional approaches to locking a bicycle or motorcycle helmet have severe disadvantages.

PRIOR ART STATEMENT

There are many solutions present in the prior art for locking these helmets. The closest art to the invention to be described known to the inventor is shown in FIG. 1, which is simply a metal cable loop 11 having one end 14 attached to a conventional padlock body 10 lockable with a key 12 to cable end 13. A somewhat similar device specifically intended for locking helmets is shown in U.S. Pat. No. 3,798,934. Therein a length of flexible cable is looped back on itself and around an external fixture such as a handlebar, and the free end passed through a hole in the helmet shell and locked. U.S. Pat. No. 3,581,531 shows a somewhat similar device in which an end is passed through the helmet shell hole and locked. U.S. Pat. No. 4,024,738 shows another helmet locking device. U.S. Pat. Nos. 4,080,020; 4,490,997; and 3,808,847 show less closely related cycle locks.

BRIEF DESCRIPTION OF THE INVENTION

My solution is to use the U lock or other padlock device used for securing a motorcycle or bicycle with the locking article of my invention to secure the helmet or other accessory as well. The locking article comprises a flexible cable loop made from a material such as steel or other metal difficult to cut. The helmet must have an aperture of predetermined size in its shell or body through which the cable loop can be passed, possibly after bending it. The loop has a stop permanently fixed on it which will not pass through the aperture without permanently damaging either the stop or the helmet. The regular bicycle or motorcycle lock, preferably of the U lock type, can be passed through the locking article's loop after it's passed through the aperture while locking the bicycle or motorcycle to an external permanent fixture. The stop then secures the helmet against theft. The locking article occupies so little space on the lock that normal use is unaffected.

Accordingly, one purpose of this invention is to lock a cycle accessory such as a helmet with a standard cycle lock.

A second purpose is to lock the accessory and the cycle simultaneously with the same lock.

Another purpose is to keep the accessory from becoming soiled by contacting a dirty frame or lock.

Yet another purpose is to provide a light, inexpensive and compact locking device for a bicycle accessory.

A further purpose is to speed up the process of locking a cycle accessory.

A still further purpose is to allow locking both a cycle and its accessory with a single key.

Other purposes will become apparent in the following description.

DESCRIPTION OF THE PREFERRED EMBODIMENTS

Figure 1:
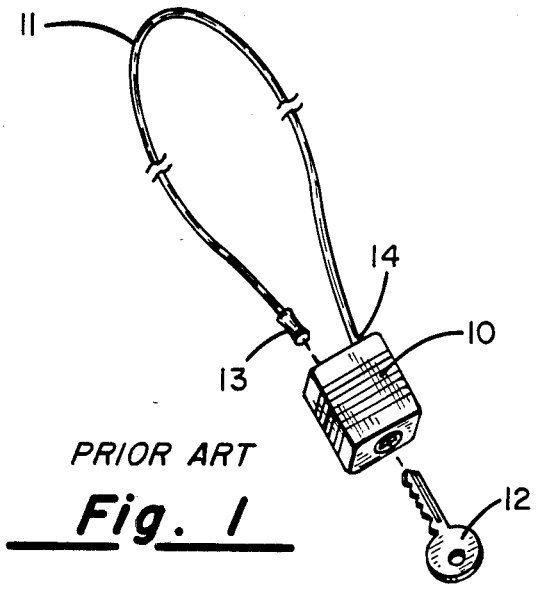
PRIOR ART Fig. 1
FIG. 1 shows the closest prior art of which the applicant is aware.
Figure 2:
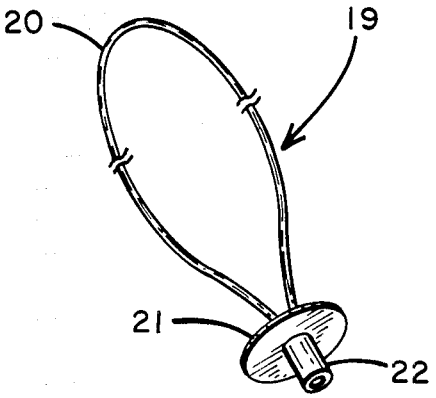
FIG. 2 is a perspective view of the locking article of the invention.

FIG. 2 shows a preferred locking article 19 which comprises a stranded or twisted steel cable loop 20 whose ends enter and are permanently joined by a clinched press sleeve fitting 22. Fitting 22 retains a metal plate such as washer 21 permanently on loop 20, the central hole of washer 21 being large enough to allow the two loop ends to enter it and so small that the fitting 22 cannot pass through it. The cable loop's stiffness prevents washer 21 from being pushed off the loop end of the cable.

Figure 3:
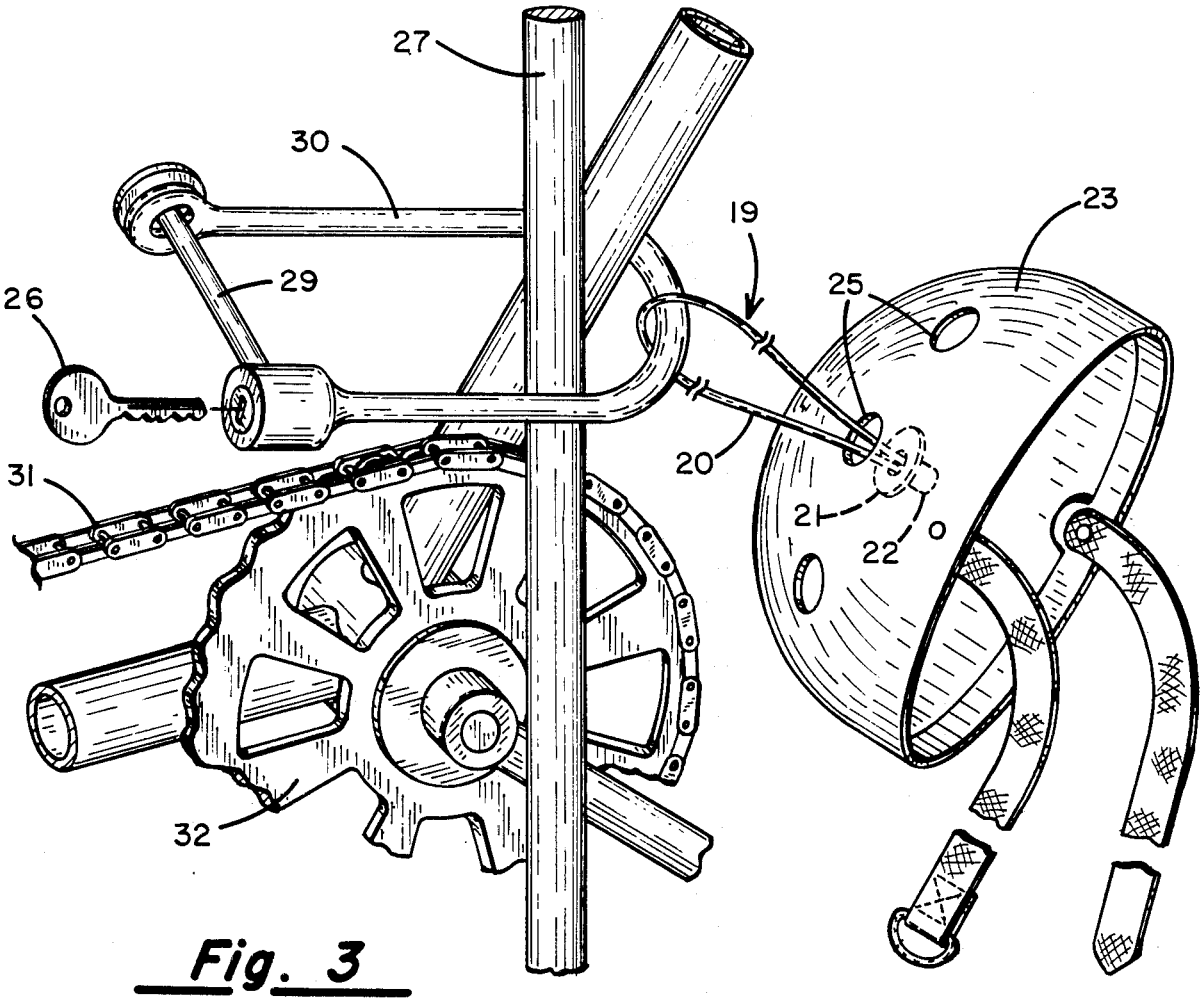
FIG. 3 is a semi-perspective view of the locking article in use with a U lock type padlock to secure a helmet and a bicycle frame to a post.

For locking a typical bicycle helmet 23 as shown in FIG. 3 I prefer to make loop 20 from 8 to 15 inches of ⅛ or 5/32 inch 7×19 or 7×7 stainless stranded cable and employ a 0.04–0.07 inch thick stainless washer 21 with a 1 to 1½ inch O.D. and a ¼ to 5/16 inch central hole. The press sleeve fitting 22 is a conventional type used to permanently join such stranded cable by squeezing it with a special tool after slipping the cable ends into it. While such a cable can be cut with a special cable cutter it is not easily cut with typical pilers or wire cutters and as such provides satisfactory security for a bicycle or motorcycle helmet or other accessory which is relatively inexpensive compared to the cycle itself.

In FIG. 3, the locking article 19 of FIG. 2 is shown with its loop 20 inserted in a cooling vent or aperture 25 of the helmet 23. Typically apertures 25 in such a helmet shell are perhaps $\frac{3}{8}$ inch wide and 1 to $1\frac{1}{2}$ inch long, or may be approximately circular as shown with a diameter of perhaps 1 inch. For a loop made of 5/32 inch 7×7 cable the aperture 25 should be of a size allowing a 5/32 inch by $\frac{7}{8}$ inch rectangle to fit within it, and for $\frac{1}{8}$ inch 7×7 cable may be somewhat smaller. This permits the loop 20 to be bent and passed through the aperture 25. Note that a suitable aperture can be added to a helmet as well.

As can be seen a washer cannot be forced through any aperture whose maximum dimension is less than the O.D. of the washer without damage to the helmet or the washer. Since the typical bicycle helmet has at least one vent aperture with a maximum dimension less than 1 inch in diameter, a helmet 23 can be securely locked using a locking article 19 having a washer 21 with an O.D. of greater than 1 inch. To be safe, I prefer a washer 21 with an O.D. of at least $1\frac{1}{4}$ inch, with $1\frac{1}{2}$ inch being ideal. As a practical matter a washer 21 need have an O.D. no larger than $1\frac{3}{4}$ inch.

In FIG. 3, a locking device such as U lock 30 is shown securing a helmet 23 and bicycle frame 28 to a permanent external fixternal fixture such as post 27. Loop 20 is slipped on U lock 30 before it is closed with bar 29 to conventionally lock the frame 28 to post 27 using key 26. Helmet 23 is thus clear of the oily chain 31 and sprocket 32 and the lock 30 as well. Since article 19 is easy to carry being light and compact, a helmet 23 can be easily secured whenever using a locking device of any type to secure a bicycle when unattended. A bicyclist is much more likely to wear his or her helmet if the helmet can be easily locked at the destination. Accordingly, this locking article is likely to increase the wearing of bicycle (and motorcycle) helmets thus substantially increasing riders' safety.

One possible variation on this locking article might have washer 21 integral with press fitting 22. Another variation may have the washer strung on the cable loop like a bead. Yet another variation can have a sleeve fitting 22 on each side of washer 21 so as to positively retain washer 21 on loop 20. Other variations are undoubtedly possible as well, although at the present time I do not consider any of these to be preferred embodiments.

Wishing, however, to protect all these variations by Letters Patent, what I claim is:

1. An article for locking an accessory having an aperture of predetermined size in its body in cooperation with a separate padlock device, comprising:

(a) a flexible cable loop made of a material relatively difficult to cut and whose ends enter and are permanently joined by a clinched press sleeve fitting, which loop can be made to pass through the aperture in the accessory; and (b) a stop retained permanently on the loop by the clinched press sleeve fitting, said stop so large as to not pass through the aperture in the accessory, so that the padlock device may be locked to the portion of the flexible loop of the article when the loop is passed through the aperture in the accessory, and to a permanent fixture whereby theft of the accessory may be impeded.

2. The article of claim 2 wherein the cable ends both enter the same end of the press fitting and the stop includes a rigid plate having a hole through which the cable ends pass, said hole being so small as to prevent the press fitting from passing through it without substantial distortion of the plate or the press fitting.

3. The article of claim 2 wherein the plate comprises a washer having a central hole of dimensions smaller than the diameter of the press fitting.

4. The article of claim 3, wherein the washer O.D. is about $1\frac{1}{2}$ inches.

5. The article of claim 3, wherein the washer hole is approximately circular with a hole diameter of from about $\frac{1}{4}$ to 5/16 inches and the cable diameter is approximately one half that of the hole diameter.

6. The article of claim 2 wherein the cable ends both pass through the hole in the rigid plate from the same side.

7. In combination, (a) an accessory having an aperture of predetermined dimensions in its body;

(b) a locking article having a flexible cable loop which is passed through the aperture in the accessory, and a stop including a clinched press fitting on the loop and a rigid plate retained permanently on the loop by the clinched press fitting, said plate being too large to pass through the accessory a aperture without damage to the accessory or the stop; and (c) a locking device having a locking element, which locking element secures the loop of the locking article passed through the aperture to an external fixture, whereby the accessory is secured against theft.

8. The combination of claim 7 wherein the rigid plate includes an area having a hole and wherein the cable loop ends pass through the rigid plate's hole, and the stop further includes a clinched press fitting on the loop retaining the rigid plate on the cable loop.

9. The combination of claim 8 wherein the cable loop has two ends which both pass through the rigid plate and into the press fitting.

10. The combination of claim 9 wherein the two ends of the cable pass through the rigid plate from the same side.

11. The combination of claim 10 wherein the two ends of the cable enter the press fitting from the same end.

* * * * *